US008635726B2

(12) United States Patent
Flick et al.

(10) Patent No.: US 8,635,726 B2
(45) Date of Patent: Jan. 28, 2014

(54) CUSHION BLADDER WITH MIDDLE LAYER HAVING GAPS AND VARIOUS POSITIONED INTERIOR WELDS

(71) Applicants: Roland E. Flick, Elma, NY (US); Scott Endress, Orchard Park, NY (US); Edward Mazzu, Hamburg, NY (US)

(72) Inventors: Roland E. Flick, Elma, NY (US); Scott Endress, Orchard Park, NY (US); Edward Mazzu, Hamburg, NY (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 13/718,730

(22) Filed: Dec. 18, 2012

(65) Prior Publication Data

US 2013/0205507 A1 Aug. 15, 2013

Related U.S. Application Data

(63) Continuation of application No. 12/536,995, filed on Aug. 6, 2009, now Pat. No. 8,332,979.

(51) Int. Cl.
*A47C 27/00* (2006.01)

(52) U.S. Cl.
USPC ..... 5/655.3; 5/706

(58) Field of Classification Search
USPC ..... 5/710–713, 706, 655.3
See application file for complete search history.

(56) References Cited

U.S. PATENT DOCUMENTS

| | | | | |
|---|---|---|---|---|
| 2,703,770 | A * | 3/1955 | Melzer | 5/710 |
| 5,022,109 | A * | 6/1991 | Pekar | 5/706 |
| 5,890,245 | A * | 4/1999 | Klearman et al. | 5/714 |
| 6,079,070 | A | 6/2000 | Flick | |
| 6,689,079 | B2 | 2/2004 | Flick et al. | |
| 6,739,001 | B2 | 5/2004 | Flick et al. | |
| 6,767,621 | B2 | 7/2004 | Flick et al. | |
| 6,813,790 | B2 | 11/2004 | Flick et al. | |
| 6,907,633 | B2 | 6/2005 | Paolini et al. | |
| 7,041,122 | B2 | 5/2006 | Paolini et al. | |
| 7,065,815 | B2 | 6/2006 | Buchanan | |
| 7,126,766 | B2 * | 10/2006 | Tomita | 359/739 |
| 7,308,725 | B2 | 12/2007 | Cazzini et al. | |
| 7,406,736 | B2 | 8/2008 | Flick | |
| 7,730,566 | B2 | 6/2010 | Flick et al. | |
| 7,954,186 | B2 | 6/2011 | Flick | |
| 2002/0170117 | A1 * | 11/2002 | Flick et al. | 5/715 |
| 2008/0097259 | A1 | 4/2008 | Flick et al. | |
| 2009/0112298 | A1 | 4/2009 | Jusiak et al. | |
| 2010/0071137 | A1 | 3/2010 | Doehler et al. | |

* cited by examiner

*Primary Examiner* — Fredrick Conley
(74) *Attorney, Agent, or Firm* — Warner Norcross & Judd LLP

(57) ABSTRACT

A cushioning device has two materials that are sealed together at their peripheral edges to form first and second sides and first and second ends. Positioned between the first and second materials is a middle material. The middle material has the top and bottom sides, a gap between the first side and the middle material and another gap between the second side and the middle material. In addition, the first material is sealed to the middle material's top side by a first set of interior welds. The second surface is sealed to the middle material's bottom surface by a second set of interior welds. The first set of welds on the middle material's top surface and the second set of welds on the middle material's bottom surface are not superimposed on each other or overlap each other.

15 Claims, 6 Drawing Sheets

CUSHION BLADDER WITH MIDDLE LAYER HAVING GAPS AND VARIOUS POSITIONED INTERIOR WELDS

RELATED APPLICATIONS

This application is a continuation of copending application Ser. No. 12/536,995, filed Aug. 6, 2009, entitled Cushion Bladder With Middle Layer Having Gaps And Various Positioned Interior Welds, which is incorporated by reference in its entirety herein.

FIELD OF THE INVENTION

The present invention relates to a cushioning device, such as an overlay for a mattress.

BACKGROUND OF THE INVENTION

Therapeutic supports for bedridden patients have been well known for many years. Such therapeutic supports include inflatable mattresses and cushions, as well as a variety of foam mattresses and cushions. Most therapeutic mattresses and cushions are designed to reduce "interface pressures," which are the pressures encountered between the mattress and the skin of a patient lying on the mattress. It is well known that interface pressures can significantly affect the well-being of immobile patients in that higher interface pressures can reduce local blood circulation, tending to cause bed sores and other complications. With inflatable mattresses, such interface pressures depend (in part) on the air pressure within the inflatable support cushions. Most inflatable therapeutic mattresses are designed to maintain a desired air volume within the inflated cushion or cushions to prevent bottoming. "Bottoming" refers to any state where the upper surface of any given cushion is depressed to a point that it contacts the lower surface, thereby markedly increasing the interface pressure where the two surfaces contact each other.

One type of therapeutic support is an inflatable cushion used as an overlay (i.e., a supplemental pad positioned on top of an existing structure, such as a mattress). For example, the Sof-Care® cushions made by Gaymar Industries, Inc. are cushions which overlay an existing mattress and which include a multitude of lower individual air chambers and a multitude of upper individual air chambers with air transfer channels therebetween. Air is transferred through the interconnecting channels to redistribute the patient's weight over the entire bed cushion. A three layer overlay cushion (see FIG. 3 to appreciate the three layers contact each side of the cushion) known as the Sof-Care® II cushion continually redistributes patient weight through more than 300 air-filled chambers and may include hand grips at the side of the cushion to assist in patient positioning. In these types of cushions, the individual air chambers remain pressurized.

A Sof-Care® II cushion embodiment is shown in FIGS. 1 to 3. The cushioning device 10 includes a cushioning section 12, which supports the user and provides pressure relief to the user so that the development of pressure ulcers is prevented or retarded. The cushioning section includes first and second sides 14 and 16.

As shown in FIGS. 1 and 2, the cushioning section 12 is an inflatable bladder having a first surface 20 and an opposing second surface 22 (i.e., the cushioning section 12 is capable of being filled with a fluid). The bladder is made of three layers of suitable puncture-resistant vinyl film or other suitable air impervious flexible material. However, the bladder may be made of two layers of air impervious flexible material, if desired.

The cushion also may include handle structures 18*a* and 18*b* (FIGS. 1, 2, and 3). The handle structures 18*a*, 18*b* are extensions of the first surface 20 and the opposing second surface 22 that define the first and second sides 14, 16 of the fluid cushioning section 12. The cushioning device 10 is a simple, one-piece device for home or hospital use which eliminates the need for on-site assembly, thereby making the cushioning device 10 easy to use for an untrained user.

The bladder has a plurality of button welds, illustrated at 24, to inhibit ballooning of the bladder. The button welds 24 produce, as illustrated in FIG. 3, an upper layer 26*a* and a lower layer 26*b* of a plurality of interconnected cells 26 in the cushioning section 12. Such upper and lower layer bladder systems have been previously disclosed, for example, in U.S. Pat. No. 5,794,289, which is hereby incorporated by reference in its entirety. The number of cells 26 in the cushioning section 12 may vary, however, suitable numbers of cells 26 include from about 150 to about 300 cells in an ordinary overlay cushion mattress. As the cells 26 exchange air or any other suitable medium, the user's weight is redistributed over the entire cushioning section 12. The cushioning section may have a height when inflated to a desirable level of about 3½ inches. However, the cushioning section's 12 height may be varied as desired. The cushioning device 10 includes at the foot end a connector 28 for receiving air from an inlet hose. However, the connector 28 may be placed at any position on the cushioning device 10.

The Sof-Care® II cushion (a) in a two layer embodiment, had the top polymeric material 20 sealed to the bottom polymeric material 22 at the edges 14 and 16 (see FIG. 1), and the various button welds 24 (see FIG. 5); (b) in a three-layer embodiment, had (i) the top polymeric material 20, a middle layer 21, and the bottom polymeric material 22 sealed together at the edges 14 and 16 (see FIGS. 1 and 4), (ii) the top polymeric material 20 sealed to the middle layer 21 to form top button welds 24*a*; and (iii) the bottom polymeric material 22 sealed to the middle layer 21 to form bottom button welds 24*b* (see FIG. 5).

In some embodiments, the edges 14, 16 are extended. The extended edges, as illustrated in FIG. 6 have handle apertures 18*a*, 18*b*. The handle apertures 18*a*, 18*b* are large enough to receive a conventional hand. When a person places their hands in the desired handle apertures 18*a*, 18*b*, the person is able to move the cushion.

There is a problem when a handle is used in the prior art cushion design. When the person pulls the cushion from the handle, the person also pulls on the seals at the button welds 24 and the edges 14 and 16. Pulling the seals in the prior art cushion design with a patient thereon during patient transfer processes increases the chance of leakage at the respective buttons welds 24 and edges 14, 16. Leakage at the button welds and edges is undesirable because it results in bottoming, described above, and/or immediate air losses. Immediate air losses sometimes occur when seals are damaged and the air is directed toward the edges 14, 16, not to the desired cells. Once the air is directed to the edges, the edges increase in size and form a "hot-dog roll" structure about the patient and then the edges may burst. Obviously, leaking, bottoming and immediate air losses are undesirable effects when a person re-positions a prior art cushion.

The current invention solves that problem in a unique three-tiered cushion design. The present invention is directed to overcoming these and other deficiencies in the art.

SUMMARY OF THE INVENTION

A cushioning device has a first material and an opposing second material that are sealed together at the peripheral edges to form a first (right) side, a first (head) end, a second (left) side, and a second (foot) end. Positioned between the first material and the second material is a middle material. The middle material has a top side, a bottom side, a first gap between the first side and the middle material and a second gap between the second side and the middle material. In addition, the first material is sealed to the middle material's top side at a first set of locations to form a first set of interior welds. The second surface is sealed to the middle material's bottom surface at a second set of locations to form a second set of interior welds. The first set of interior welds on the middle material's top surface and the second set of interior welds on the middle material's bottom surface are not superimposed on each other or overlap each other.

DETAILED DESCRIPTION OF THE INVENTION

Figure 1:
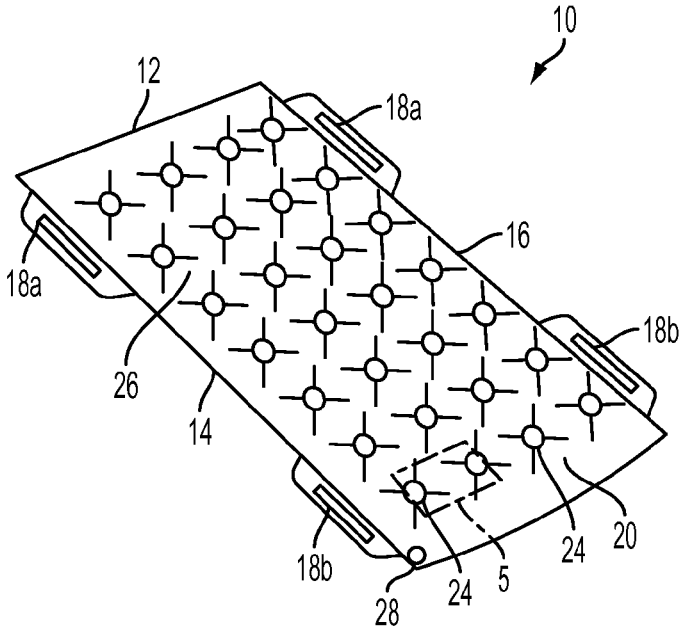
FIG. 1 PRIOR ART
FIG. 1 is a prior art perspective view of a cushioning device.
Figure 2:
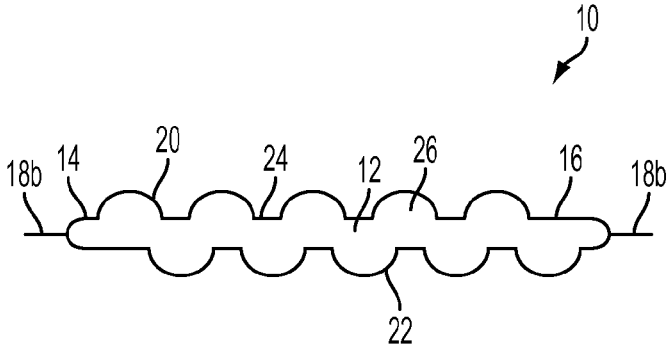
FIG. 2 PRIOR ART
FIG. 2 is a prior art cross-sectional view of the cushioning device of FIG. 1.
Figure 3:
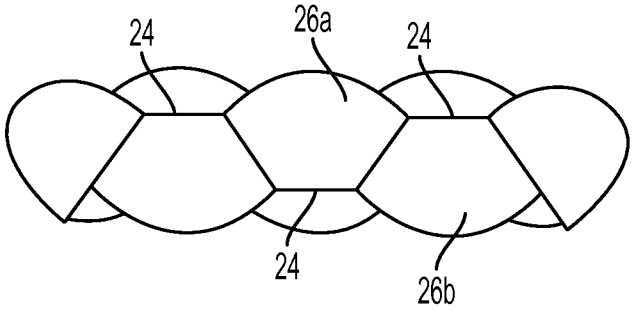
FIG. 3 PRIOR ART
FIG. 3 is a prior art perspective view of a bed including a prior art cushioning device.
Figure 4:
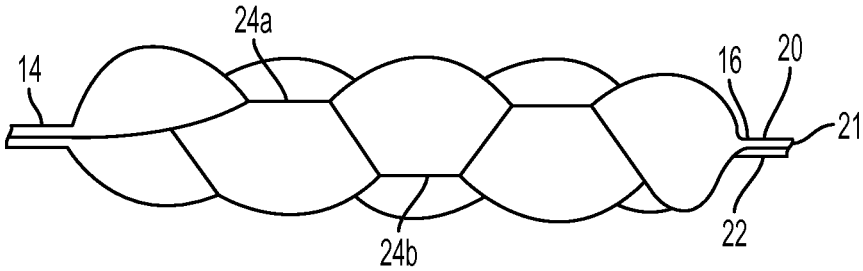
FIG. 4 PRIOR ART
FIG. 4 is a prior art alternative cross-sectional view of the cushioning device of FIG. 1.
Figure 6:
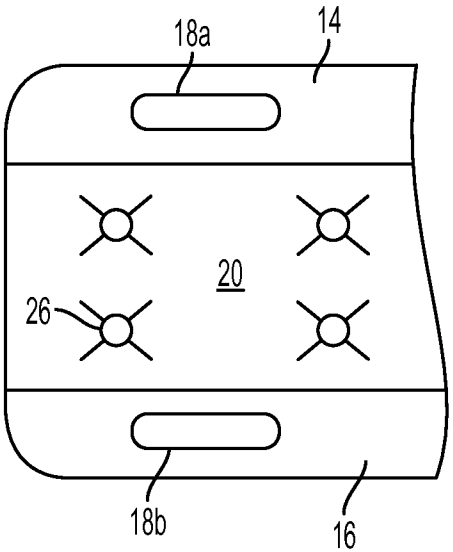
FIG. 6 PRIOR ART
FIG. 6 is a prior art top view of FIG. 1.
Figure 5:
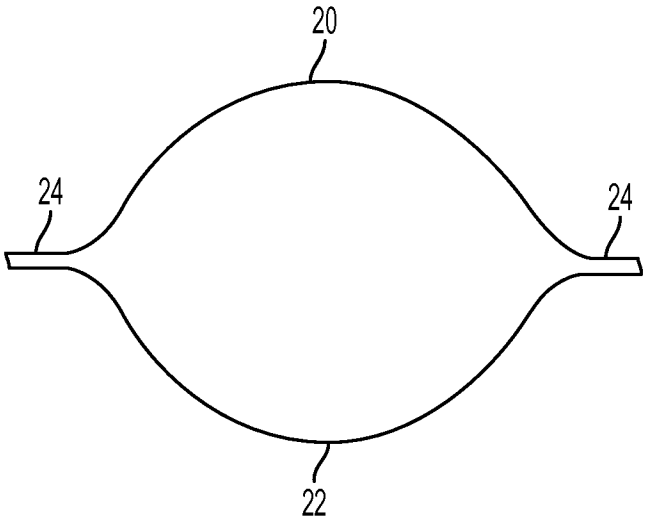
FIG. 5 PRIOR ART
FIG. 5 is a prior art cross-sectional view of FIG. 1 taken from box 5.

The above-identified prior art cushion structure and the claimed invention are similar in some ways, and different in others.

The claimed invention is a cushioning device 200 as shown in FIGS. 7-10. The cushioning device 200 includes a cushioning section 212, which supports the user and provides pressure relief to the user so that the development of pressure ulcers is prevented or retarded. The cushioning section 212 is an inflatable bladder having a first surface 220 and an opposing second surface 222 (see FIG. 8) joined at a first (right) side 214, a first (head) end 215, a second (left) side 216 and/or a second (foot) end 217.

The first surface 220 and the opposing second surface 222 can each be a three-ply puncture-resistant vinyl film or other suitable air impervious flexible material, a two-ply air impervious flexible material, or an air impervious flexible material. The first surface 220 and the opposing second surface 222 can also be two distinct pieces of material or one material piece folded over. In addition, the first surface 220 and the second surface 222 are joined together at the first side 214, the first end 215, the second side 216 and/or the second end 217 by conventional sealing methods. Conventional sealing methods include and are not limited to heat sealing, sonic welding, and adhesives.

The cushioning device 200 includes at the first end 215 or the second end 217 a connector 228 for receiving air, or possibly another fluid like water, from an inlet hose interconnected to a pump system. The pump system can be Gaymar's Sof-Care pump or any other conventional pump system that can direct air or other fluids into and possibly out of the cushion device 200.

The cushioning device 200 has a plurality of interior welds, illustrated at 224, to inhibit ballooning of the bladder. Interior welds means the welds are not at the first side 214, the first end 215, the second side 216 and/or the second end 217. In a preferred embodiment the interior welds are button welds, and in certain embodiments bar welds.

Button welds have an exterior diameter and in some embodiments an interior diameter. The area (a) within the exterior diameter or (b) between the exterior and interior diameters is sealed and conventionally joins a first material and a second material together. Those sealed areas are formed by conventional sealing methods that include and are not limited to heat sealing and sonic sealing.

The interior welds and configuration of the current cushioning device provide a reinforced, unitary cushion design. The first surface 220 and the second surface 222 are not joined together to form conventional interior welds, which include button welds. Instead, the interior welds are formed between (a) the first surface 220 and first areas on a top surface of a middle material 221 to form a top fluid area 302 ("first set of interior welds 224*a*") and (b) the second surface 222 and second areas on a bottom surface of the middle material 221 to form a bottom fluid area 304 ("second set of interior welds 224*b*"). See FIGS. 7, 8, and 9.

Figure 7:
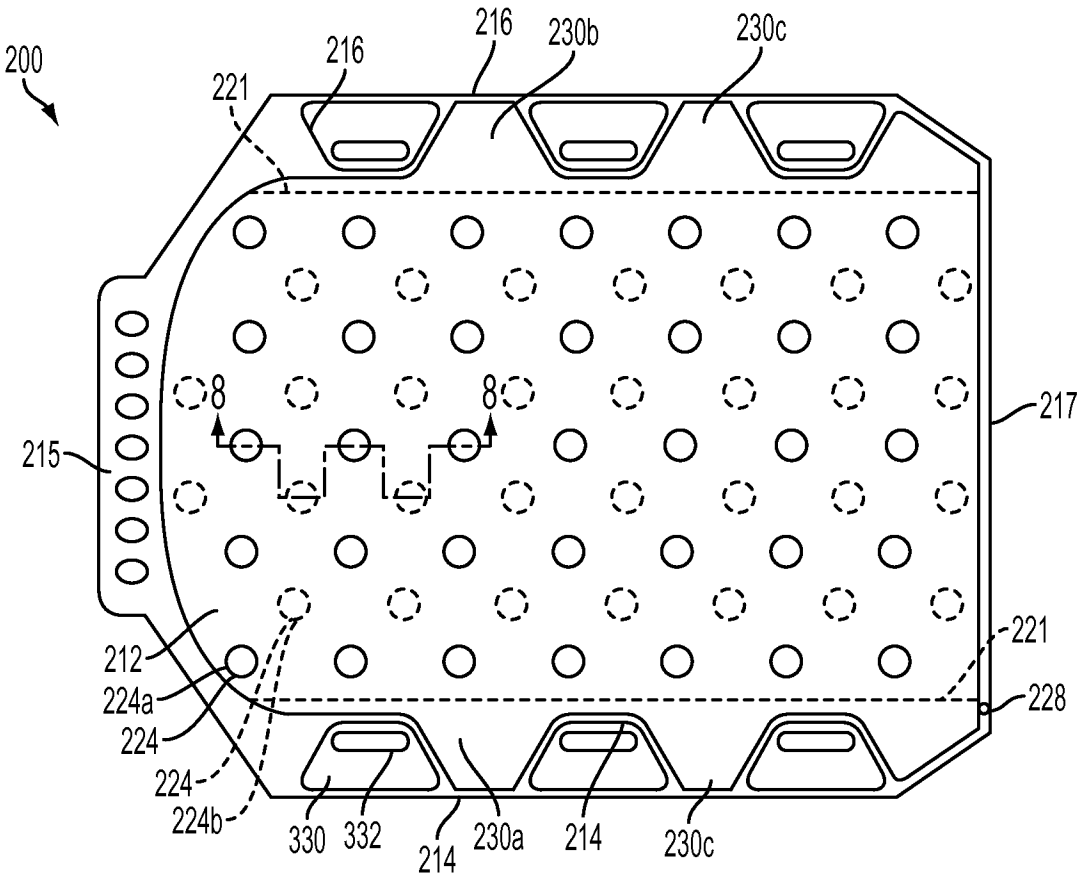
FIG. 7 illustrates a top view of the present invention wherein the middle layer and the bottom welds are illustrated in phantom lines.
Figure 8:
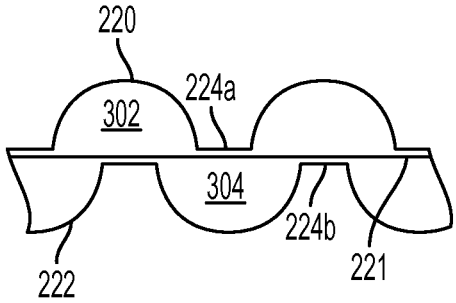
FIG. 8 illustrates a cross-sectional view of FIG. 7 along the line 8-8.

The first set of interior welds and the second set of interior welds are not at the same location on the respective surfaces of or superimposed on the middle material. The first set of interior welds and the second set of interior welds are positioned a distance from each other. As illustrated in FIG. 7 the first set of interior welds 224*a* can be a plurality of first rows and the second set of interior welds 224*b* are (a) in a plurality of second rows wherein each second row is adjacent to a first row and (b) staggered, in some embodiments, in relation to the first set of interior welds. In every embodiment, the first and second sets of interior welds are positioned a distance from each other. In other words:

A. The first set of interior welds on the middle material's top surface are in a first set of rows.
   1. The second set of interior welds on the middle material's bottom surface are in a second set of rows, and the first set of rows and the second set of rows are not superimposed on each other.
      i. The first set of rows and the second set of rows are adjacent to each other.

B. The first set of interior welds on the middle material's top surface are in a first set of columns.
   1. The second set of interior welds on the middle material's bottom surface are in a second set of columns, and the first set of columns and the second set of columns are not superimposed on each other.
      i. The first set of columns and the second set of columns are adjacent to each other.

The middle surface 221 is a material that can be heat sealed or sonic sealed to the first surface 220 and the second surface 222. In addition the middle surface 221 can be the same or different material as the first surface 220 and/or the second surface 222. Conventionally, the middle surface, the first surface and the second surface have some and sufficient amount of polymeric fibers therein that allow these materials to effectively seal together.

The middle surface 221 connects with the seal between the first surface 220 and the second surface 222 at the first end 215 and the second end 217. The middle surface 221, however, does not connect with the seals between the first polymeric surface 220 and the second polymeric surface 222 at the first side 214 and the second side 216.

By not connecting to the first side 214 and the second side 216, there is a first gap area 230*a* between the middle surface 221 and the first side 214; and a second gap area 230*b* between the middle surface 221 and the second side 216.

Those gaps 230*a*, 230*b* allow air (see arrows at FIG. 9) to circulate between the top fluid area 302 and the bottom fluid area 304.

Figure 10:
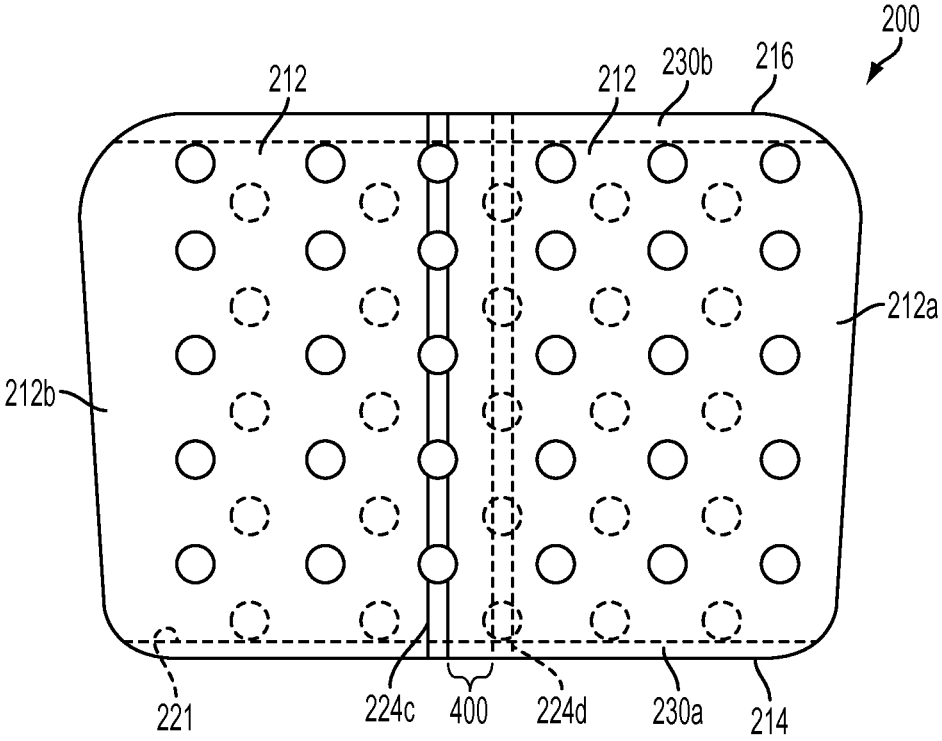
FIG. 10 illustrates an alternative embodiment of the present invention.

FIG. 10 illustrates an alternative cushion embodiment that conforms to the current invention and used in association with bariatric and/or pediatric patients. The alternative cushion embodiment has two cushioning sections 212*a*, 212*b*. The first cushioning section 212*a* is defined by (a) a first bar weld 224*c* is formed between the first surface 220 and the top surface of the middle material 221 through a column of the first set of interior welds and extends from the first side 214 to the second side 216 through the gap areas 230*a*, 230*b* only for the width of the bar weld; and (b) a second bar weld 224*d* is formed between the second surface 222 and the bottom surface of the middle material 221 through a column of the second set of interior welds and extends from the first side 214 to the second side 216 through the gap areas 230*a*, 230*b* only for the width of the bar weld. The second cushioning section 212*b* is defined by the remainder of the cushion section 212 of the cushion device 200. The first bar weld 212*a* and the second bar weld 212*b* do not superimpose or overlap each other. Thereby there is an overlap area 400 between the first cushioning section 212*a* and the second cushioning area 212*b*.

These overlapping cushioning sections 212*a*, 212*b* ensure there is no area in the cushion device's 200 cushioning sections 212*a*, 212*b* that does not provide fluid pressure to the patient. The overlapping cushioning sections also ensure the patient positioned on the cushion device is on a relatively planar surface—there are no obvious indentations at the bar weld areas.

As indicated above, the overlapping cushioning sections 212*a*, 212*b* can each be inflated to the same pressure or alternatively to different pressures. That means each section 212*a*, 212*b* has an inlet to receive the desired pressure. By controlling the pressures in the respective sections 212*a*, 212*b* and having the overlapping sections 212*a*, 212*b*, the tissue interface pressure can be controlled to decrease the chance of forming bed sores.

At the first side 214 and second side 216 are handle areas 330 and extended gap areas 230*c*. The handle areas 330 are located where the first surface 220 and the second surface area 222 are joined together. Each handle area 330 has a handle aperture 332. The handle aperture 332 is shaped to receive a person's hand so the person can push or pull the cushioning device 200 to a desired location. Between the handle areas 330 along the first side 214 and the handle areas 330 along the second side 216 are extended gap areas 230*c*. The extended gap areas 230*c* are enlarged areas of (a) the first gap area 230*a* between the middle surface 221 and the first side 214; and (b) the second gap area 230*b* between the middle surface 221 and the second side 216.

The interior welds 302, 304 (normally button weld configurations) and gaps 230*a*, 230*b*, 230*c*, in combination, provide greater flexibility to the bladder, decreases the stress applied to the seal between the first surface 220 and the second surface 222 at the first side 214 and the second side 216, and increases the bladder's loft near the first and second sides 214, 216 in relation to the prior art.

Since the interior welds 302, 304 are not superimposed over and under each other, the first surface 220 and the second surface 222 are not structured to meet at the same interior locations. By not being structured to meet at the same interior locations, the first surface 220 and the second surface 222 are also not subject to the identical pressures applied by a patient lying thereon.

The lack of identical pressures allows the first surface 220 and the second surface 222 to redistribute the patient's body weight through the middle surface 221. Moreover, the middle surface 221 promotes the redistribution by not concentrating the pressures at identical weak points in the interior section of the cushion 200—the interior welds. The redistribution occurs because the first surface 220 and the second surface 222 having some independence from each other in the cushion's interior section. Independence refers to the facts that the top and bottom welds 224*a*, 224*b* are (a) not superimposed on each other and (b) connected to a middle layer 221 that is not interconnected to the sides 214, 216 that in turn provides some freedom of movement not absolutely controlled by the top surface 220 or the second surface 222. That independence decreases the stress applied to the first surface 220 and the second surface 222 that can result in leaks at the first side 214 and/or the second side 216. In some instances the leaks result in hot-dog explosions that cause immediate air loss from the entire bladder. Uncontrolled air loss is undesirable.

Leaks are further defused by having the gaps 230*a*, 230*b*, 230*c* act as valve releases between the top fluid area 302 and the bottom fluid area 304.

Leaks are further defused in the current invention when the first side 214 and/or the second side 216 have handle areas 330. The handle areas 330 with handle apertures 332 allow a person to position their hands therein. Once the hands are properly positioned in the handle apertures 332, the person can pull on the handles to re-position the cushioning device 200 to a desired position. The top fluid area 302 and the bottom fluid area 304 separated by the middle polymeric surface 221, the interior button welds 302, 304 having the above-identified configuration on the middle polymeric surface 221 and gaps 230*a*, 230*b*, 230*c* between the middle surface 221 and the first and second sides 214, 216 act collectively as a valve that decreases the pressure and stress applied to the cushioning device 200 when being moved. Thereby the current invention further decreases the chance of forming leaks in the cushioning device 200 at handle areas 330.

The top fluid area 302 and the bottom fluid area 304 separated by the middle surface 221, the interior welds 302, 304 having the above-identified configuration on the middle surface 221, and the gaps 230*a*, 230*b*, 230*c* between the middle surface 221 and the first and second sides 214, 216 also ensure the air is properly circulated and maintained in desired locations. When the air is properly circulated and maintained in desired locations, the bladder's loft near the first and second sides 214, 216 is greater in relation to the prior art's loft.

The use of the cushioning device of the present invention will now be described in detail. In use, the cushioning device is positioned on a support structure and secured using straps, if present. The cushioning device 200 is then connected to an inflation device, such as a pump. The pump is activated to inflate the cushioning device 200. A user is then positioned on the cushioning device 200 and the cushioning device 200 is checked to confirm that it is not bottoming out. Alternatively, the user may be positioned on the cushioning section prior to inflating the cushioning device 200.

The cushioning device 200 customizes itself to the body weight and configuration of each individual patient that lies thereon. By conforming to the patient, the cushioning device 200 decreases external pressures from compressing, becoming rigid and adding pressure to body tissues. By design, the cushioning device requires a simple hand check to ensure the cushion 200 is maintaining proper pressure.

Figure 9:
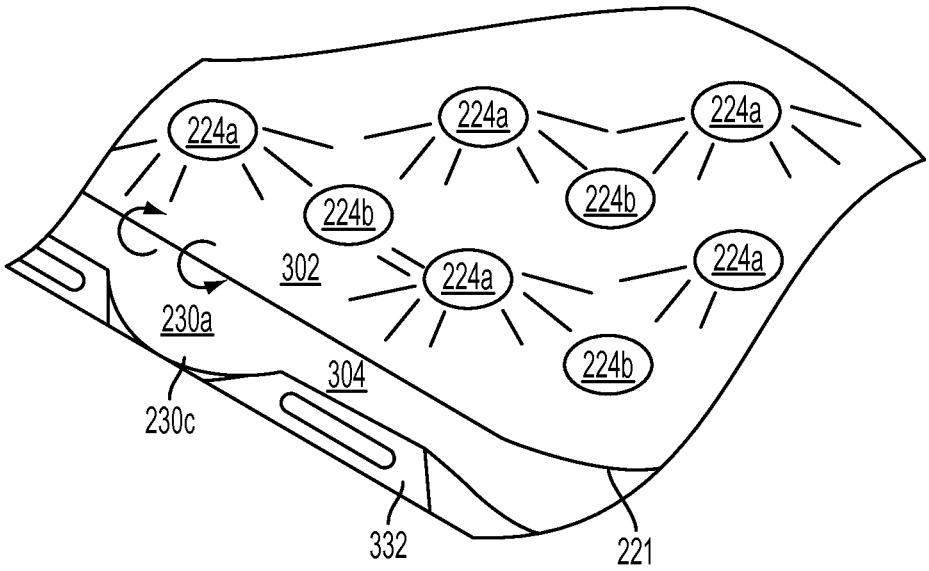
FIG. 9 illustrates an alternative embodiment of FIG. 7 wherein the top surface is removed.

The bariatric cushioning embodiment illustrated in FIG. 10 can also have handles as illustrated in FIGS. 7 and 9. The only caveat is that the bar welds 224*c*, 224*d* are interconnected to the handle areas 330 and not the extended gap areas 230*c*.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

We claim:

1. A cushioning device comprising:

a first layer of air impervious material having a first perimeter edge and a second layer of air impervious material having a second perimeter edge wherein the first perimeter edge and the second perimeter edge are sealed together to form a first side, a first end, a second side, and a second end;

a middle layer positioned between the first layer and the second layer to form an upper fluid area and a lower fluid area and extending from said first end to said second end but terminating inwardly of said first and second sides to allow air flow between said upper fluid area and said lower fluid area, said middle layer having an upper surface and a lower surface, said first layer being joined to said middle layer at said upper surface by a first set of welds, and said second layer being joined to said middle layer at said lower surface by a second set of welds; and said first set of welds spaced and offset from said second set of welds wherein when said upper and lower areas are filled with a fluid said first layer and said second layer form lofted structures that are spaced and offset from each other.

2. The cushioning device of claim 1 wherein the middle layer is formed from a different material that said first layer and/or said second layer.

3. The cushioning device of claim 1 wherein said welds comprise button welds or bar welds.

4. The cushioning device of claim 3 wherein said welds comprise button welds.

5. The cushioning device of claim 1 wherein said first set of welds are arranged in rows.

6. The cushioning device of claim 5 wherein the second set of welds are arranged in rows spaced and offset from the rows of said first set of welds.

7. The cushioning device of claim 1 wherein the middle layer comprises a heat or sonic sealable material to the first layer and the second layer.

8. The cushioning device of claim 1 wherein the first layer is selected from the group consisting of a three-ply puncture-resistant vinyl film, an air impervious flexible material, and a two-ply air impervious flexible material.

9. The cushioning device of claim 1 wherein the second layer is selected from the group consisting of a three-ply puncture-resistant vinyl film, an air impervious flexible material, and a two-ply air impervious flexible material.

10. The cushioning device of claim 1 further comprising at least a first handle area having a first handle aperture and a second handle area having a second handle aperture on the first side or the second side.

11. The cushioning device of claim 1 wherein said middle layer includes opposed peripheral edges, said peripheral edges being generally parallel and spaced inwardly from said first and second sides, respectfully, to thereby form first and second gaps between said middle layer and said first and second sides, respectively.

12. The cushioning device of claim 1, wherein said cushioning device has a width, said first layer being joined to said middle layer at said upper surface by a first weld that extends across the width of said cushioning device.

13. The cushioning device according to claim 12, wherein said second layer is joined to said middle layer at said lower surface by a second weld that extends across said width, wherein said first and second welds divide said cushioning device into two sections each with upper and lower fluid areas isolated from the other of the upper and lower fluid areas.

14. The cushioning device according to claim 13, wherein said first weld is spaced from said second weld.

15. The cushioning device according to claim 1, wherein said first layer and said second layer include handle areas adjacent each of said first side and said second side.

* * * * *